US005564855A

United States Patent [19]

Anderson

[11] Patent Number: 5,564,855

[45] Date of Patent: Oct. 15, 1996

[54] HEIGHT ADJUSTMENT RING FOR MANHOLE COVER FRAME

[75] Inventor: Dennis C. Anderson, Northfield, Minn.

[73] Assignee: National Polymers Inc, Lakeville, Minn.

[21] Appl. No.: 251,181

[22] Filed: May 31, 1994

[51] Int. Cl.[6] ..... E02D 29/14

[52] U.S. Cl. ..... 404/26; 52/21

[58] Field of Search ..... 404/25, 26; 52/19–21

[56] References Cited

U.S. PATENT DOCUMENTS

| | | | |
|---|---|---|---|
| 3,773,428 | 11/1973 | Bowman | 404/26 |
| 4,121,390 | 10/1978 | Hall et al. | 404/26 X |
| 4,759,656 | 7/1988 | Wilson | 404/26 |
| 4,763,449 | 8/1988 | Vigneron et al. | 52/20 |
| 4,772,154 | 9/1988 | Caroulle | 404/25 |
| 5,209,601 | 5/1993 | Odill et al. | 404/26 |
| 5,211,504 | 5/1993 | Tudel | 404/26 |
| 5,221,155 | 6/1993 | Neil | 404/26 |

*Primary Examiner*—Michael Powell Buiz

*Attorney, Agent, or Firm*—James V. Harmon

[57] ABSTRACT

A stackable height adjustment ring for supporting a manhole cover frame upon a concrete manhole shaft liner has a ring body that is formed from plastic resin, e.g., scrap plastic. The ring includes inner and outer radially spaced apart side walls and optionally a top wall. Brace arms which are integral with the walls preferably extend radially between the walls for holding them together. The rings have alignment members, e.g., an inner wall of the ring can have an upwardly facing shoulder upon its upper edge and the outer wall, a downwardly facing shoulder on its lower edge. An upwardly extending cylindrical collar at the top of the outer ring fits the downwardly facing shoulder of an adjacent ring. There is also a downwardly extending collar at the lower edge of the inner ring to fit on the upwardly facing shoulder of a similar inner ring. The alignment members enable each ring to be held in alignment upon each successive ring beneath it so that the rings can be stacked one upon another to adjust the elevation of the manhole cover frame above a concrete manhole shaft liner. Optionally, the rings have engageable ramps for adjusting the pitch of an upper one of two stacked rings.

13 Claims, 6 Drawing Sheets

HEIGHT ADJUSTMENT RING FOR MANHOLE COVER FRAME

FIELD OF THE INVENTION

This invention relates to a manhole cover frame supporting ring system.

BACKGROUND OF THE INVENTION

Since it is extremely difficult to determine the final grade, elevation or pitch of the blacktop when sewers are installed, construction workers come as close as possible to the target elevation and then establish the final elevation of the manhole cover housing by inserting a spacer ring composed of concrete. Concrete spacers are, however, subject to breakage in shipment. U.S. Pat. No. 4,759,656 proposes that an elastomer be used for this purpose. An elastomer such as rubber, although capable of forming a tight seal against concrete or iron, is expensive. Rubber can also creep over time. By contrast, it is an object of the present invention to provide a spacer ring composed of scrap plastic, such as scrap beverage containers, and thereby provide a very inexpensive product but one with a provision for achieving a tight seal even though the plastic body of the spacer itself is rigid.

It has been proposed, for example in U.S. Pat No. 4,763,449, to utilize plastic resin, e.g., polyethylene, as a gasket for the manhole cover itself but the gasket merely encloses the edge of a flange and is not suited to support a manhole cover housing. In addition, it is not self-aligning nor stackable (capable of being mated together in a stack one on top of another).

In view of these shortcomings, it is an object of the present invention to provide a stackable manhole housing height adjustment ring which (a) requires substantially less resin than previously used, (b) is self-aligning with respect to adjacent rings or other objects, (c) will hold the manhole cover housing in a fixed position, (d) although itself rigid, has a provision for establishing a reliable seal between adjacent rings and between itself and adjacent concrete or iron surfaces, and (e) has an optional feature for changing the pitch of the top ring.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a stackable height adjustment ring for supporting a manhole cover frame or housing upon a concrete manhole cone or shaft liner. The ring includes a ring body formed from plastic resin such as scrap plastic. The ring body can be solid but most preferably has openings through it. To accomplish this objective, one preferred form of ring is made up of inner and outer radially spaced apart cylindrical walls. Brace arms preferably extend radially between them for holding the walls together. Extensions project vertically to form an engagement or coupling between the rings to hold them in alignment. The inner wall of the ring preferably has an upwardly facing shoulder upon its upper edge, and the outer well preferably has a downwardly facing shoulder on its lower edge. There is an upwardly extending cylindrical collar that serves as an alignment member at the top of the outer wall which fits the downwardly facing shoulder of the next ring above it. In the preferred form of the invention, there is also a downwardly extending collar at the lower edge of the inner wall that fits on the upwardly facing shoulder of an inner wall below it. In this way, each ring is held in alignment with a similar ring located beneath it. During use the rings can be stacked one upon another to adjust the elevation of the manhole cover frame. One or more rings can be used to achieve the right spacing. The upwardly extending collar is also preferably sized to fit around the outer edge of the manhole cover frame. In this way the upper collar establishes a central recess on the top surface of the ring for the manhole cover frame to hold the frame securely in a fixed position. In one optional form of the invention, a tilting member is provided on one side of each ring for elevating that edge to align the ring with the surface of the ground.

THE FIGURES

DESCRIPTION OF THE PREFERRED EMBODIMENT

Figure 1:
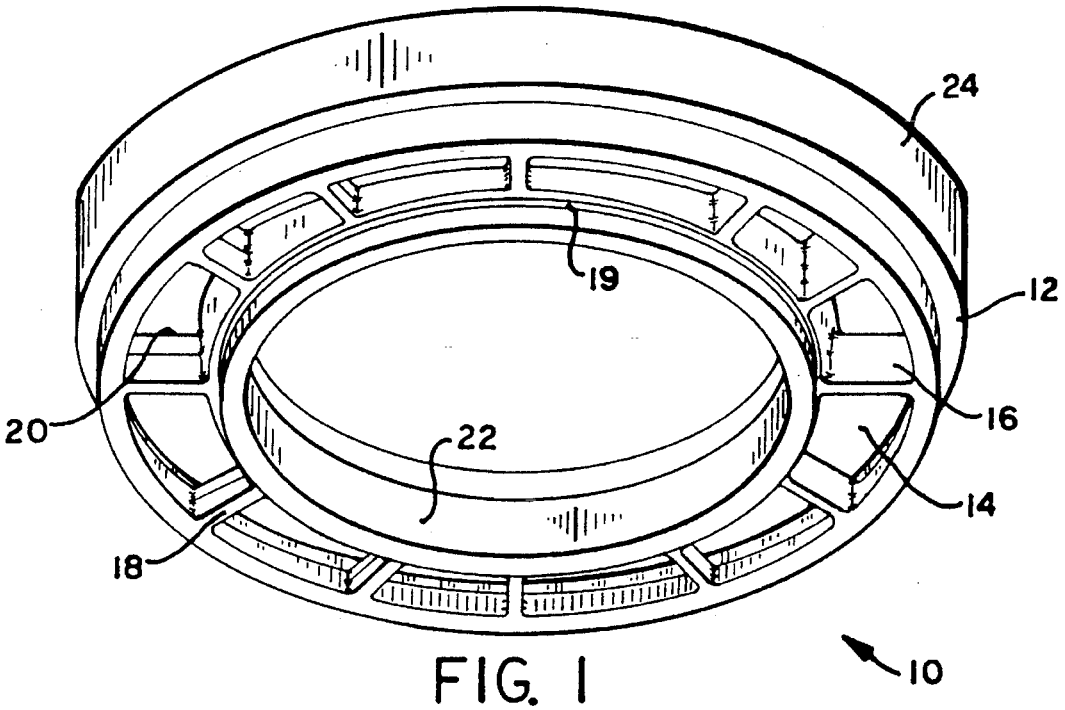
FIG. 1 is bottom perspective view of a manhole cover frame height adjustment ring of the present invention.
Figure 2:
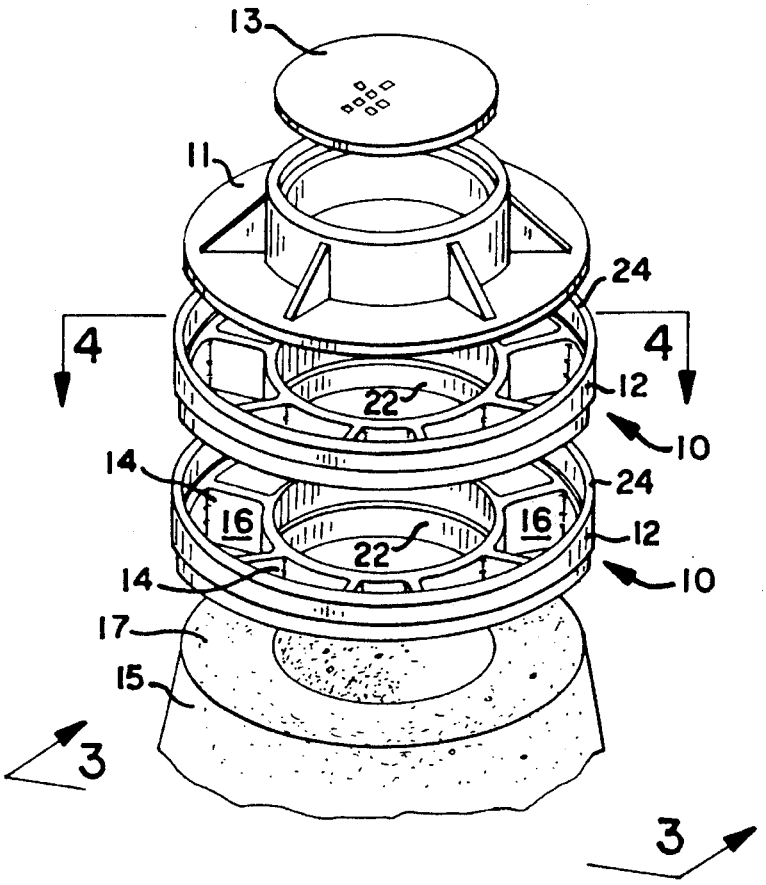
FIG. 2 is an exploded perspective view showing two superimposed stacking rings in accordance with the invention positioned between a manhole cover frame and a concrete manhole shaft liner cone.
Figure 3:
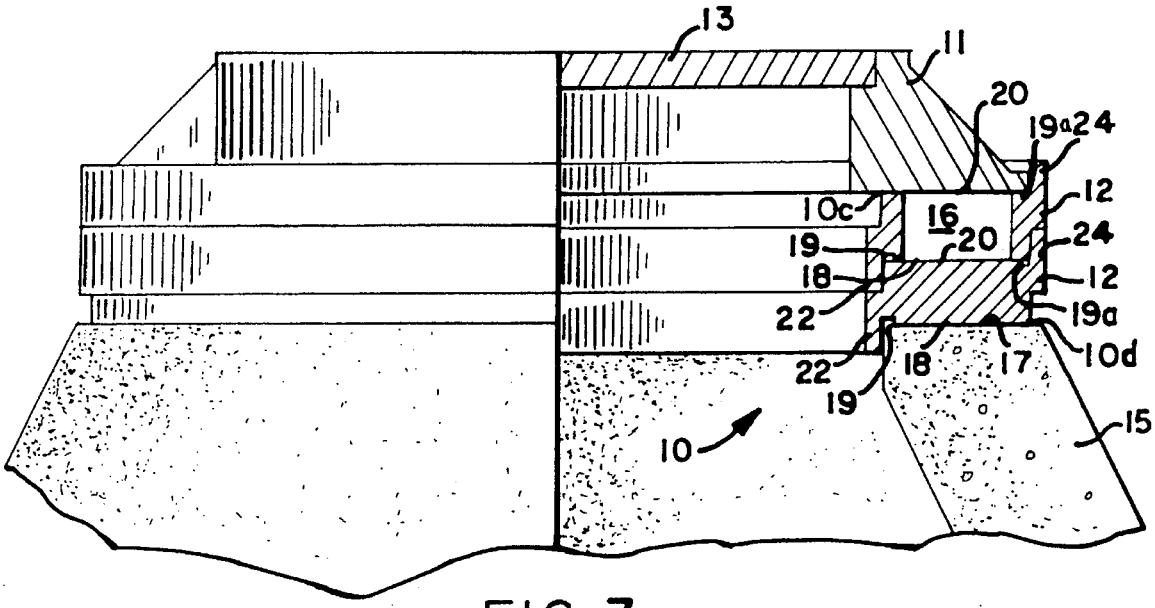
FIG. 3 is a vertical side elevational view of two rings partly in section on line 3—3 of FIG. 2 as they appear when installed.
Figure 4:
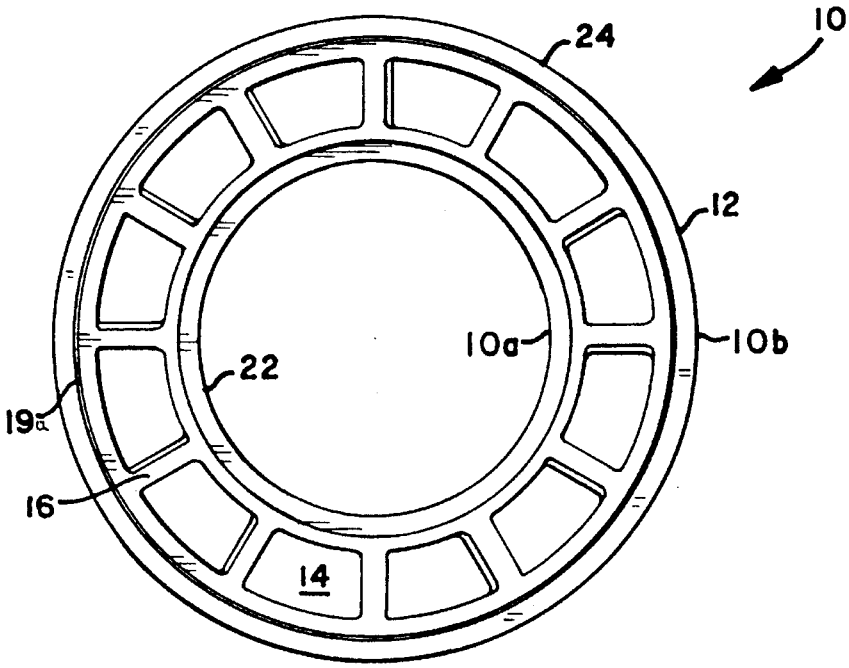
FIG. 4 is a top plan view of the invention taken on line 4—4 of FIG. 2.

In FIGS. 1–4 is shown a stackable height adjustment ring 10 for supporting a conventional manhole cover frame or housing 11 which is closed at the top by means of a manhole cover 13. The height adjustment ring 10 is supported during use upon the upper surface 17 of a concrete manhole shaft liner cone 15 (FIGS. 2 and 3).

The height adjustment ring 10 of the present invention includes inner and outer radially spaced apart concentric side walls 10*a* and 10*b*, typically about 1 inch thick which are joined by means of radially extending, circumferentially spaced apart integral plastic brace arms 16 for holding the walls 10*a*, 10*b* together. Openings 14 between the brace arms 16 extend from the top of the height adjustment ring 10 to the bottom and thus provide vertical passages all the way through the ring 10. Each stackable height adjustment ring 10 has a bottom surface 18 and a top surface 20 about 2 inches apart which, when the rings are stacked, contact one another as shown in FIG. 3. The inner wall 10*a* includes a downwardly extending collar 22 and the outer wall 10*b* includes an upwardly extending collar 24. The collar 22 is sized to fit upon an upwardly facing shoulder 10*c* on the inner wall 10*a*, and the collar 24 is adapted to fit over and receive a downwardly facing shoulder 10*d* on the lower edge of the outer wall 10*b*. In this way the stacking height adjustment rings 10 will be held securely in alignment and cannot shift relative to one another when stacked one upon another as shown in FIG. 3. In addition, the manhole cover housing 11 will fit nicely within an upwardly facing recess provided centrally of the collar 24 and therefore will be held in a fixed position by the upper stacking ring 10. Typically, the height adjustment ring 10 has an outside diameter of 37 inches and an inside diameter Of 26 inches.

The bottom surface 18 of the inner wall 10*a* has a circular upwardly extending, downwardly opening caulking groove 19 and the upper surface 20 has a circular downwardly extending, upwardly opening caulking groove 19*a*, both of which extend entirely around the ring circumferentially and during use are filled with any suitable caulking material to provide a seal between the stacking height adjustment rings 10 and between a ring 10 and adjacent concrete and metal surfaces as shown in FIG. 3. Consequently, the height adjustment rings 10 of the present invention, although rigid, are self-sealing.

The height adjustment rings 10 according to the present invention can be used singly or stacked on top of one another in any desired number to support the manhole cover frame 11 at any desired elevation above the concrete shaft liner cone 15. Usually from one to three of the stackable height adjustment rings 10 are used.

The stackable height adjustment rings of the present invention are rugged in construction, low in cost, and form a tight seal. In addition, the collars 22, 24 of the height adjustment rings 10 hold adjacent rings 10 securely in alignment and reliably keep the manhole cover frame 11 centered on the concrete manhole shaft liner cone 15. The stackable height adjustment rings 10 preferably comprise a single monolithic injection molded integral piece of plastic resin and as such are virtually indestructible. The height adjustment rings of the present invention are also lighter and easier to handle than concrete rings and much less subject to breakage during shipment than concrete spacer rings.

Figure 5:
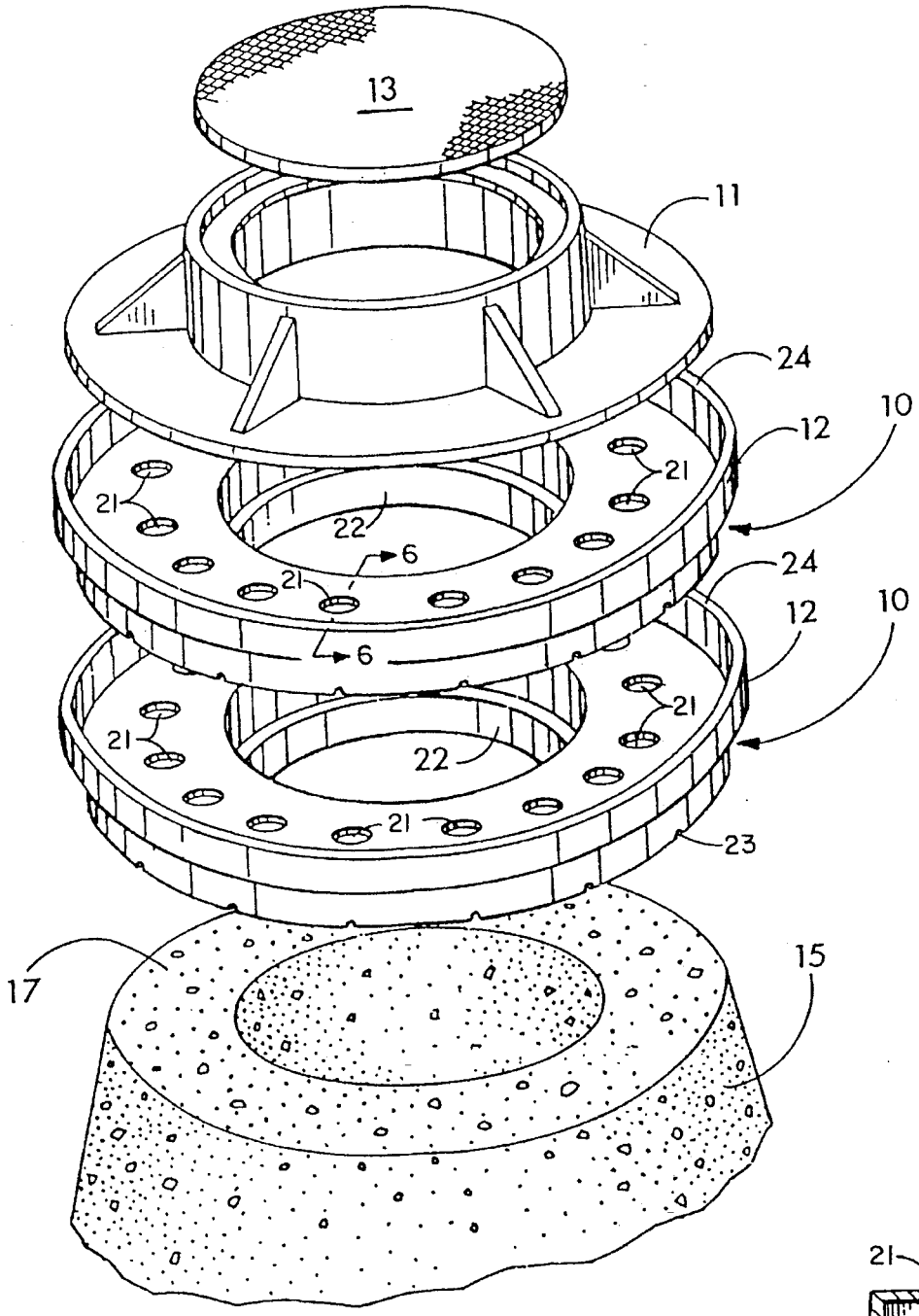
FIG. 5 is an exploded perspective view showing two superimposed stacking rings in accordance with another embodiment of the invention positioned between a manhole cover frame and a concrete manhole shaft.
Figure 6:
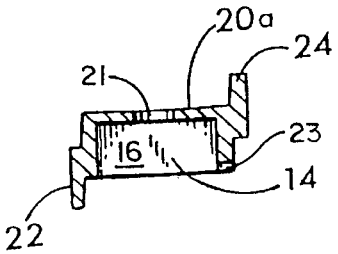
FIG. 6 is a transverse sectional view taken on line 6—6 of FIG. 5.

Refer now to FIGS. 5 and 6 which illustrate another embodiment of the invention wherein the same numerals refer to corresponding parts already described.

The embodiment of FIGS. 5 and 6 is similar to that of FIGS. 1–4 except that over the plastic brace arms 16 and covering the opening 14 is a circular, horizontally disposed integral top wall 20*a* which serves as a base or supporting surface for the manhole cover frame 11 or, in case two rings are used, as a supporting surface for the upper ring (the top ring 10 as shown in FIG. 5). The wall 20*a* is typically about one-half to three-fourths inches thick and is provided with a plurality of circumferentially spaced apart drain openings 21 to prevent moisture from accumulating within the rings. Along the lower edge of the outer circular side wall 10*b* of the ring 10 are provided a plurality of weep holes 23, also for the purpose of preventing moisture accumulation. The top wall 20*a* strengthens the ring 10, provides additional rigidity and also helps to distribute the weight of the manhole cover frame 11. The wall 20*a* also converts each of the openings 14 into a box-like chamber having side walls 16, inner and outer circular walls 10*a*, 10*b* and a top wall 20*a*, thereby defining a series of side-by-side five-sided, generally rectangular chambers extending circumferentially around the ring 10.

Figure 7:
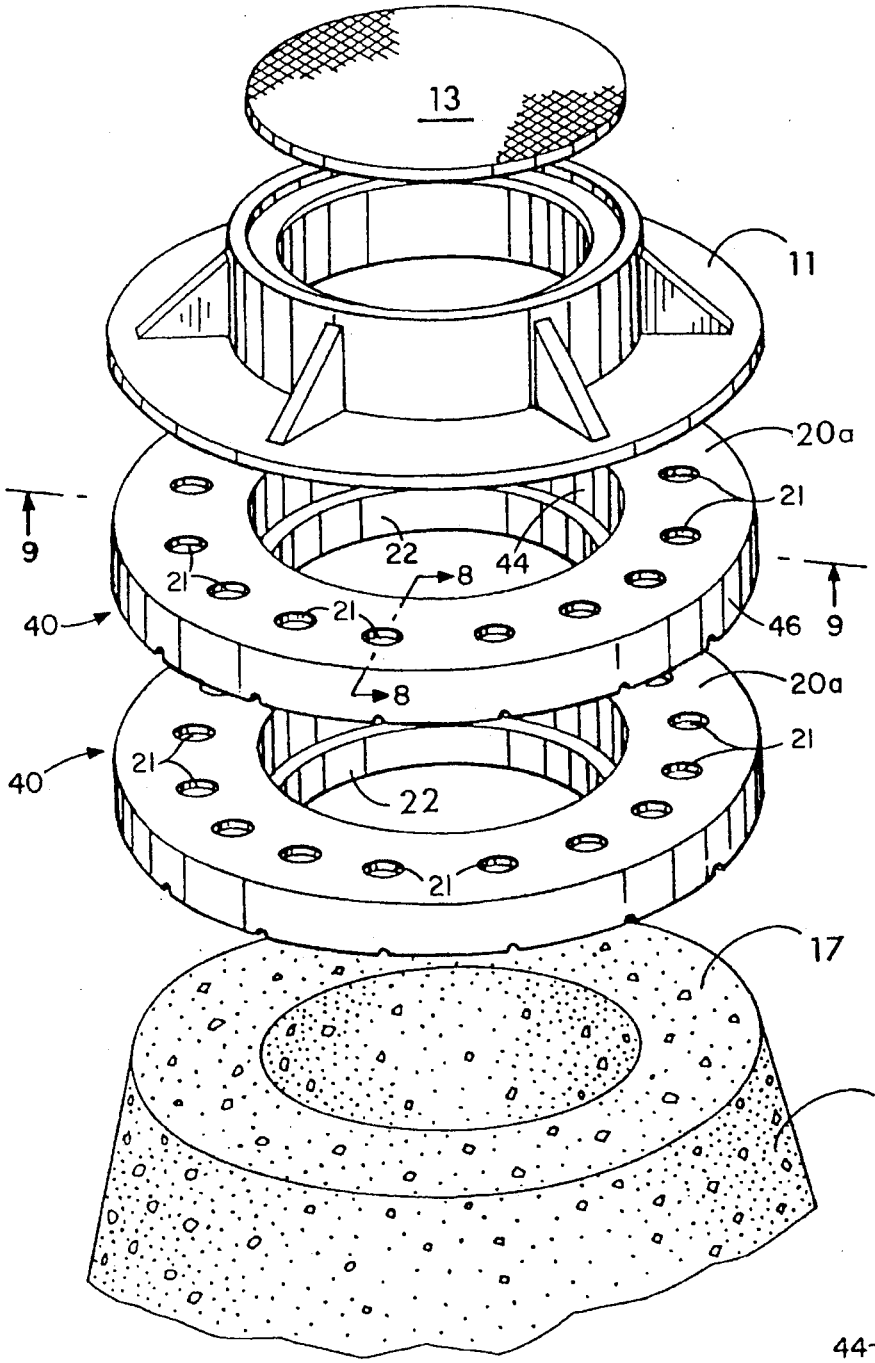
FIG. 7 is an exploded perspective view showing two superimposed stacking rings in accordance with another embodiment of the invention positioned between a manhole cover frame and a concrete manhole shaft.
Figure 8:
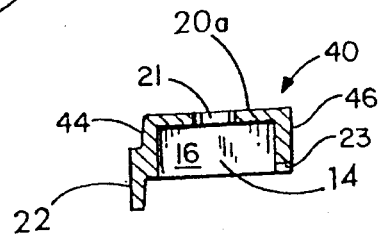
FIG. 8 is a vertical sectional view taken on line 8—8 of FIG. 7.
Figure 9:
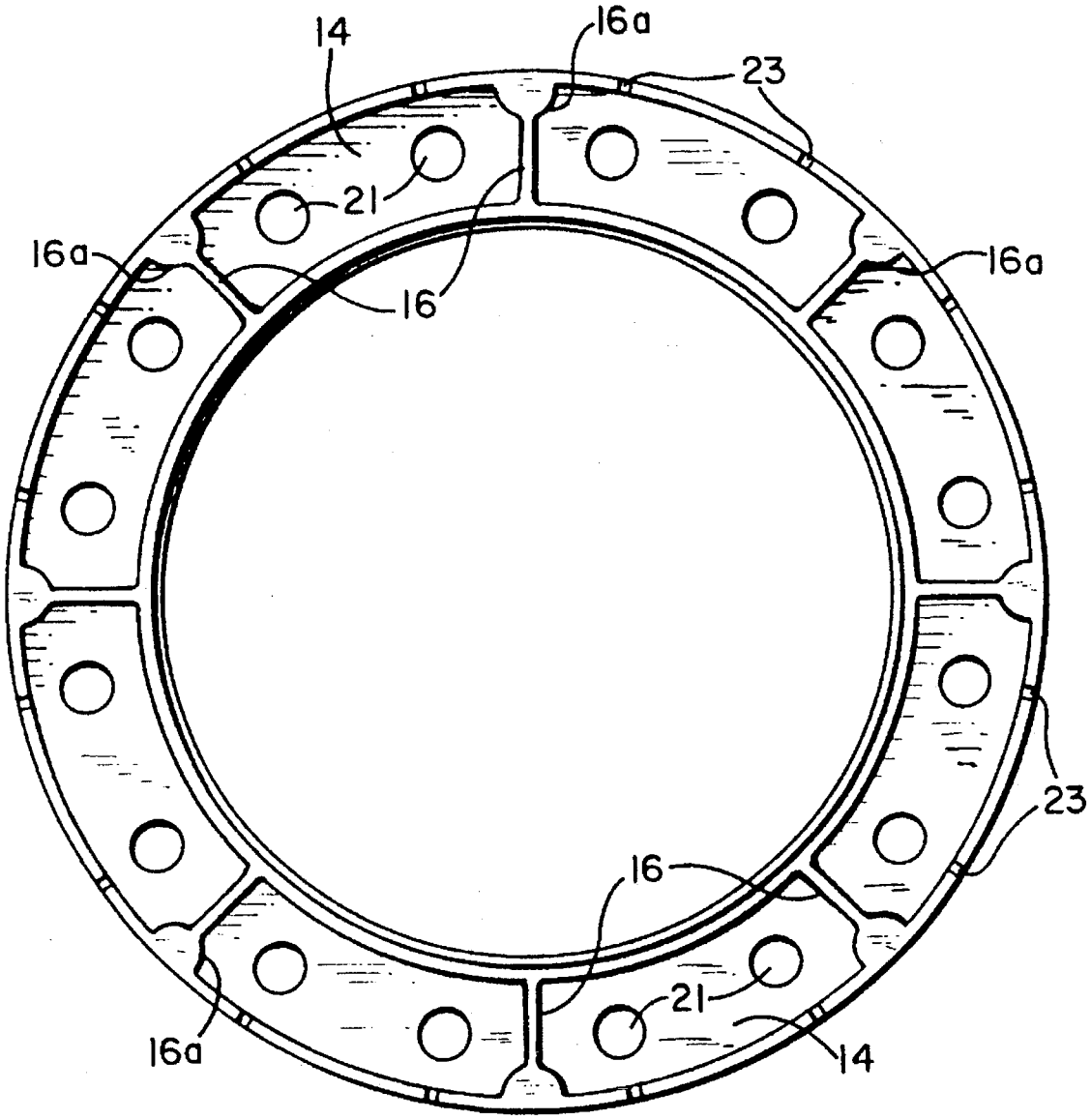
FIG. 9 is a bottom view taken on line 9—9 of FIG. 7.

Refer now to FIGS. 7–9 which illustrate another embodiment of the invention, in this case a pair of identical manhole frame supporting rings 40 similar to those in FIGS. 5 and 6 except that the upper collar 24 is absent. The advantage of the rings 40 is that they require less material than those described hereinabove. However, the manhole cover frame 11 can move laterally across the flat upper surface 20*a* unless the manhole frame 11 has one or more extensions or a counterbore that projects into one of the openings 21 or the center opening 42 of the ring 40. As in the other embodiments described above, the collar 22 aligns the rings and prevents the rings 40 from slipping sideways relative to one other, i.e., maintains their concentricity by virtue of the collar 22 extending into the circular opening 42 at the top of the ring 40 below it. Similarly, the collar 22 extends into the center opening of the manhole shaft cone 15.

Refer now to FIG. 9. As shown in the figure, the radially extending, circumferentially spaced apart upright brace arms 16 each extend from the inner circular wall 44 to the outer circular wall 46. The outer end portion 16*a* of the arm 16 is thickened to serve as a supporting column, each of which is generally hemi-cylindrical in shape but which can have other shapes such as square or circular. The columns 16*a* improve rigidity and the load bearing capacity of the ring.

Refer now to FIGS. 10–13 which illustrate an embodiment of the invention that will allow angular adjustment between a pair of stacked rings to make it possible for the top manhole cover frame to be set at an inclined angle corresponding with that of the road surface when the road surface is other than horizontal, for example when the road is crowned and the manhole is to be placed at other than the center of the road.

To accomplish this objective, a manhole frame supporting ring 50 which consists of a ring-shaped plastic body 52 formed from plastic resin such as recycled polyethylene or polypropylene is provided with circular concentric outer and inner side walls 54 and 56, flat parallel top and bottom surfaces 58 and 60, and an integral elevating ramp 62 which extends circumferentially of the ring 50 partially around its outside wall 54. The top surface 58 is in this case a top wall which joins the side walls 54, 56.

Figure 10:
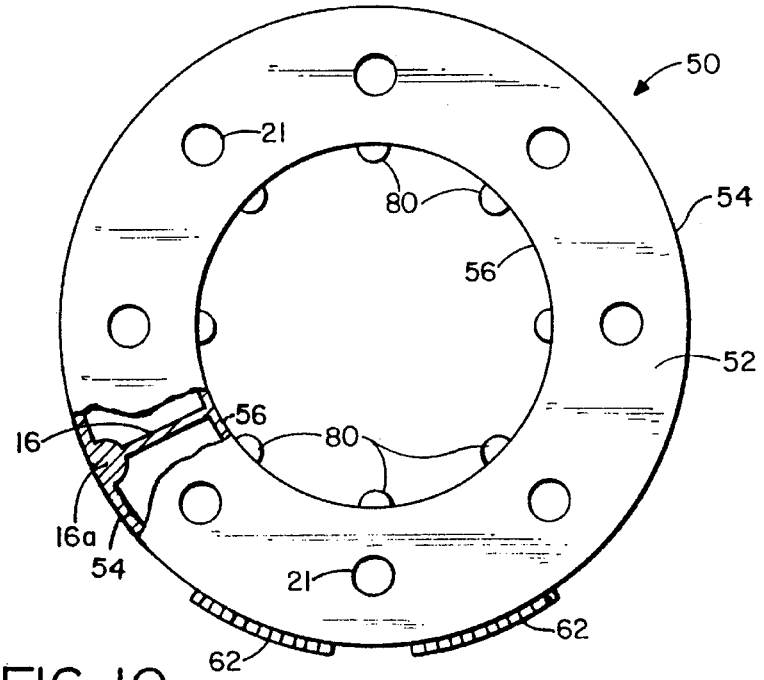
FIG. 10 is a plan view of another embodiment of the invention.

Extensions or lugs 80 project vertically to form an engagement or coupling between the rings 50 to hold them in alignment. In this way, each ring 50 is held in alignment with a similar ring 50 located beneath it. The extension 80 serves as a vertically extending alignment member projecting vertically from the ring 50 in a position to contact a similar ring below the ring 50. The ring 50 has a socket, namely, the space inside the inner side wall 56, to receive the alignment member 80 whereby the rings 50 can be placed one above another in stacked relationship with the alignment members of one of the rings 50 projecting into the socket (the space inside the side wall 56) of the other ring to maintain the rings 50 in vertical alignment one above another during use as shown in FIGS. 10 and 11.

The ramp elements 62 are arcuate as seen from above and have parallel upper and lower edges 66, 68 which are provided with tooth-like projections 70 (shown engaged in FIG. 12) and vertical side walls 71, 72. The projections 70 are the same on both ramp surfaces 66 and 68 so that they mate when they are superimposed and placed in contact as shown in FIG. 12. In a typical application where the ring 50 has a diameter of about 37 inches, the ramps 62 have a thickness as seen from above of about one or two inches. The ramps 62 are molded integrally into the resinous body of the ring 52 and are part of the monolithic molded resinous structure of the ring 52. In the alternative, the ramps 62 can be separate pieces attached to the ring 52 with fasteners, but this is more expensive to produce. The rings 50 are stacked in pairs as shown in FIGS. 11–13 when the manhole frame is other than horizontal. However, if it is not necessary to place the manhole frame 11 at an oblique angle, a single ring 50 can be used or the rings 50 can be stacked parallel to one another as shown in FIG. 11 without engaging the ramp elements 62.

In order to use the rings 50, one begins by noting the required pitch angle required for the manhole frame 11. Two or more of the rings 50 are then placed in stacked relationship as shown in FIG. 11. The upper ring 50 is then rotated so as to engage the proper number of teeth 70 as shown in FIG. 12 to elevate that side of the ring 50 having the ramp 62 by the amount required to establish the desired pitch to match the grade of the road as shown in FIGS. 12 and 13. The space between the rings 50 is then filled with mortar 74 and the manhole frame 11 is mounted on the top ring.

Figure 11:
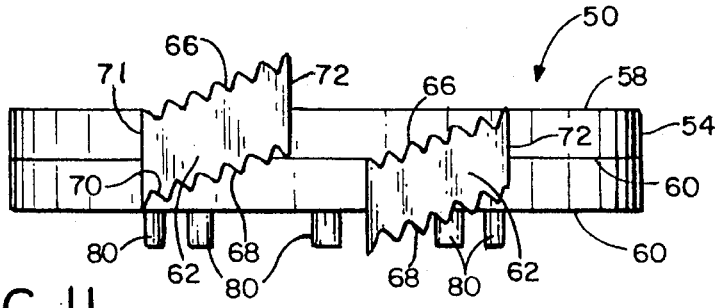
FIG. 11 is a side elevational view of two of the supporting rings of FIG. 10 in stacked relationship.
Figure 12:
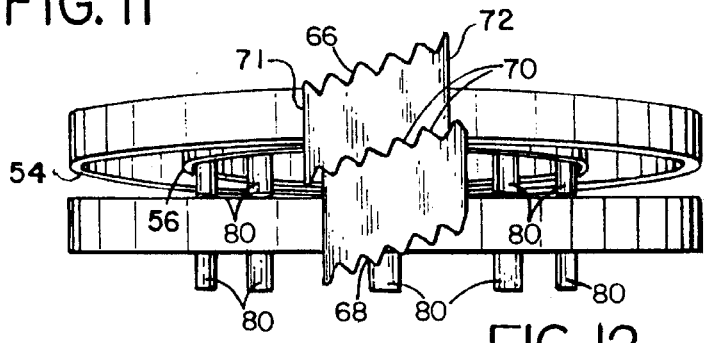
FIG. 12 is a side elevational view showing the stacked rings with the top ring pitched at an oblique angle by engaging the pitch adjustment ramps.
Figure 13:
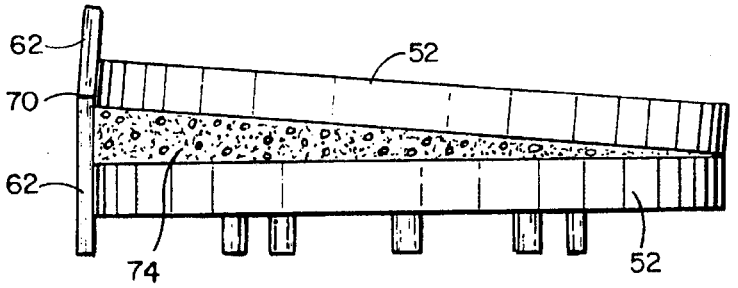
FIG. 13 is a right side elevational view of FIG. 12.

The rings 50 are particularly useful because they can be employed in a flat configuration either singly or stacked as shown in FIG. 11, or pitched at an angle as shown in FIGS. 12 and 13 by engaging the teeth 70. The teeth 70 can have any of a variety of shapes, e.g., sinusoidal or shaped like gear teeth. The teeth can also have spaces between them if desired. It is important, however, that the teeth 70 on the upper ramp edge 66 be the same as on the lower ramp edge 68 so they will mesh together when brought into contact. By engaging different numbers of teeth, the angle of inclination (pitch) of the top ring can be set at any selected value. If desired, the teeth 70 can be eliminated completely, in which case the ramp surfaces 66, 68 will be smooth. The ramps 62 can then be secured together, for example, by means of a construction adhesive or a mechanical fastener such as a bolt (not shown) which is passed through the engaged ramps 62 after they are placed in contact to fasten them together. This, however, is not a preferred embodiment since it adds expense and is more time consuming to assemble.

Many variations of the present invention within the scope of the appended claims will be apparent to those skilled in the art once the principles described herein are understood.

What is claimed is:

1. A stackable height adjustment ring for supporting a manhole cover frame comprising, a ring body formed from polymeric material, said ring body including concentric inner and outer radially spaced apart upright side walls, the outer side wall defines an outside peripheral edge of the ring and the inner side wall comprises an inside edge of the ring surrounding a central opening, said inner and outer side walls having an annular passage therebetween extending from a top portion of the ring body to a bottom portion of the ring body, at least one vertically extending alignment member projecting from the ring in a position to contact a similar ring stacked above or below said ring, said ring having a portion to receive said alignment member of another such ring, the ring includes radially extending circumferentially spaced apart brace arms located between the inner and outer side walls thereof, whereby the rings can be placed one above another in a stacked relationship with the alignment member of one of said rings projecting into said portion for receiving said alignment member to thereby maintain the annular passages above one another during use.

2. The height adjustment ring of claim 1 wherein a plurality of integral vertically extending columns formed from plastic resin are provided in the ring to provide additional strength for supporting said manhole frame.

3. The height adjustment ring of claim 2 wherein the columns are connected to said brace arms as a portion thereof adjacent an outer end of the brace arm.

4. A stackable height adjustment ring according to claim 1 wherein a pitch adjustment ramp is provided as a part of the ring, each pitch adjustment ramp includes inclined upper and lower vertically spaced apart ramp surfaces, whereby a pair of such rings can be placed in stacked relationship with the ramp surfaces in engagement with each other for changing the angular relationship between the rings by elevating that portion of atop ring of said pair where the ramp surfaces are engaged to thereby tilt the top ring at an oblique angle relative to an adjacent ring for holding the pitch of the top ring at a selected value.

5. The height adjustment ring of claim 4 wherein the ramp surfaces have teeth for holding the ramp surfaces in a selected position when the upper ramp surface of a lower ring is placed in contact with the lower ramp surface of the top ring to thereby establish the desired pitch angle of the top ring.

6. The stackable height adjustment ring of claim 1 wherein a circular horizontal top wall joins upper edges of the inner and outer side walls.

7. The height adjustment ring of claim 6 wherein drain holes are provided in said horizontal wall.

8. A stackable height adjustment ring for supporting a manhole cover frame comprising, a ring body formed from polymeric material, said ring having an upright circular outer surface defining an outer periphery of the ring and said ring also having an upright circular inner surface surrounding a central opening, at least one vertically extending alignment member projecting vertically from the ring in a position to contact a similar ring stacked above or below said ring, said ring having a portion to receive said alignment member whereby the rings can be placed one above another in a stacked relationship with the alignment member of one of said rings projecting into said portion of another ring for receiving said alignment member to thereby maintain the rings one above another during use, each ring includes inclined upper and lower vertically spaced apart ramp surfaces so that by placing a top one of the rings above another such ring with the ramp surfaces thereof in engagement with each other an angular relationship is established between the rings by the engaged ramp surfaces which elevate a portion of said top ring to thereby tilt said top ring at an oblique angle relative to an adjacent ring for holding the pitch of the top ring at a selected value.

9. The stackable height adjustment ring of claim 8 wherein said ring has a hollow interior.

10. The stackable height adjustment ring according to claim 9 wherein the height adjustment ring includes circumferentially spaced apart brace arms between said outer surface and said inner surface.

11. The height adjustment ring of claim 8 wherein the height adjustment ring includes a plurality of circumferentially spaced apart, vertically disposed supporting columns formed from polymeric material to provide additional compressive strength for the ring.

12. The apparatus of claim 8 wherein the alignment member comprises a plurality of circumferentially spaced apart, vertically disposed alignment lugs extending vertically from said ring and adapted to engage an adjacent side wall of a similar ring positioned vertically of said ring and adjacent thereto.

13. The apparatus of claim 8 wherein each of the ramps comprises a ramp element formed from a body of polymeric material as a part of the ring and each of the ramp surfaces is substantially parallel to the other and aligned vertically therewith, and wherein the ramp surfaces have teeth for holding the ramp surfaces in a selected position when an upper ramp surface of a lower ring is placed in contact with a lower ramp surface of an upper ring to thereby establish the desired pitch angle of the upper one of said rings.

* * * * *

UNITED STATES PATENT AND TRADEMARK OFFICE

CERTIFICATE OF CORRECTION

PATENT NO. : 5,564,855
DATED : October 15, 1996
INVENTOR(S) : Anderson

It is certified that error appears in the above-indentified patent and that said Letters Patent is hereby corrected as shown below:

On the title page, item [75] Inventors: should read

Dwight G. Wiedrich, Lino Lakes, Minnesota
Dennis C. Anderson, Northfield, Minnesota Signed and Sealed this Seventeenth Day of August, 1999

*Attest:*

Q. TODD DICKINSON

*Attesting Officer*

*Acting Commissioner of Patents and Trademarks*